US011638672B2

(12) United States Patent
Burch

(10) Patent No.: US 11,638,672 B2
(45) Date of Patent: May 2, 2023

(54) HEAD-UP SPINAL DECOMPRESSION DEVICE

(71) Applicant: Kenneth A Burch, Mesa, AZ (US)

(72) Inventor: Kenneth A Burch, Mesa, AZ (US)

( * ) Notice: Subject to any disclaimer, the term of this patent is extended or adjusted under 35 U.S.C. 154(b) by 507 days.

(21) Appl. No.: 16/544,047

(22) Filed: Aug. 19, 2019

(65) Prior Publication Data

US 2021/0052457 A1 Feb. 25, 2021

(51) Int. Cl.
*A61H 1/02* (2006.01)

(52) U.S. Cl.
CPC ... *A61H 1/0229* (2013.01); *A61H 2201/0157* (2013.01); *A61H 2201/0161* (2013.01);
(Continued)

(58) Field of Classification Search
CPC .. A61H 1/0229; A61H 1/0292; A61H 1/0218; A61H 1/00; A61H 1/02; A61H 1/0222; A61H 1/008; A61H 3/008; A61H 2201/0157; A61H 2201/0161; A61H 2201/0173; A61H 2201/1253; A61H 2201/1614; A61H 2201/1616; A61H 2201/1623; A61H 2201/1628; A61H 2201/163; A61H 2201/1635; A61H 2201/1638; A61H 2201/165; A61H 2201/1652; A61H 2203/0481; A61H 2203/0487; A61H 2203/0493; A61H 2205/081; A61H 2001/0203; A61H 2001/0251; A61F 5/04; A61F 5/042; A61F 5/048; A61F 5/05; A61F 5/055; A61F 5/01; A61F 5/0102; A63B 23/1227; A63B 23/0238; A63B 23/0216; A63B 23/0405;
(Continued)

(56) References Cited

U.S. PATENT DOCUMENTS 4,729,395 A * 3/1988 Adamson ..... A61H 3/00 482/66
4,869,279 A * 9/1989 Hedges ..... A61H 3/00 135/67

(Continued)

OTHER PUBLICATIONS

Permanent definition. The Free Dictionary. Adj definition 2, https://www.thefreedictionary.com/permanent (Year: 2020).*

(Continued)

*Primary Examiner* — Rachael E Bredefeld
*Assistant Examiner* — Trisha Talapatra
(74) *Attorney, Agent, or Firm* — Etherton Law Group, LLC

(57) ABSTRACT

A spinal decompression device from which a user suspends himself with his head up, taking advantage of gravity to stretch his spine and relieve tension in his back. Two crosspieces are connected at their middle portions to form an X. Each crosspiece has an arm near the top and a foot at the bottom, all extending horizontally and perpendicularly to the crosspieces. The height of the arms and their distance apart from each other are adjustable to fit each user so that the user may control the amount of his body weight suspended between the arms during treatment, by resting his feet on the ground. The device is collapsible for easier storage. A safety strap may be connected between the lower portions of each cross piece to prevent accidental collapse of the device. Wheels may be attached to the feet to make the device easier to move.

10 Claims, 5 Drawing Sheets

(52) U.S. Cl.
CPC ..... *A61H 2201/0173* (2013.01); *A61H 2201/1253* (2013.01); *A61H 2201/1638* (2013.01); *A61H 2203/0487* (2013.01); *A61H 2205/081* (2013.01)

(58) Field of Classification Search
CPC . A63B 23/0227; A63B 23/02; A63B 23/0205; A63B 21/00047; A63B 21/068; A63B 21/4029; A63B 2023/003; A63B 2023/006; A63B 1/00; A63B 3/00
USPC ..... 602/32, 39–40; 135/65, 67, 68, 69, 71, 135/74–75
See application file for complete search history.

(56) References Cited

U.S. PATENT DOCUMENTS 5,224,924 A * 7/1993 Urso ..... A61H 1/0222 135/73
5,402,587 A * 4/1995 Buschbacher ..... A61H 3/00 280/87.021
10,080,701 B1 * 9/2018 Bagheri ..... A61H 3/04
10,391,018 B1 * 8/2019 Fitzwater ..... A61H 1/00
2007/0163633 A1 * 7/2007 Gale ..... A61H 3/04 280/87.021
2015/0136190 A1 * 5/2015 Thomas ..... A61H 3/04 280/638
2015/0328079 A1 * 11/2015 Liles ..... A61H 3/04 135/67
2016/0296792 A1 * 10/2016 Mosher ..... A61H 1/0229

OTHER PUBLICATIONS

Locked definition. The Free Dictionary. V.Tr. definition 3. https://www.thefreedictionary.com/lock (Year: 2020).*
Misterbackpain_ 8 Ways to Relieve Severe Lower Back Pain (When You Can Barely Walk) (Year: 2022).*
Adjustable Fitness Power Tower . . . WorkoutStation . . . screenshot downloaded from www.amazon.com Jul. 12, 2019.

* cited by examiner

HEAD-UP SPINAL DECOMPRESSION DEVICE

FIELD OF INVENTION

This invention relates to exercise and physical therapy devices for decompressing a user's spine. This invention relates particularly to an apparatus that enables a user to take advantage of gravity to decompress the spine while being suspended with his head up.

BACKGROUND

Many people experience discomfort or pain around the neck, upper back, and lower back. Treatments range from surgery and medication, to spinal manipulation and physical therapy. A conventional type of physical therapy used to relieve back pain and discomfort is spinal decompression using inversion therapy. Inversion therapy involves hanging upside down on an inversion table or by gravity boots, so that the direction of the force of the body pulling down on the spine is reversed from normal standing, taking pressure off the nerve roots and disks in the spine and increasing the space between vertebrae. Unfortunately, the head-down position is risky for anyone with high blood pressure, heart disease or glaucoma because the user's heartbeat slows and blood pressure increases when inverted for more than a couple of minutes—and the pressure within the eyeballs jumps dramatically. In addition, it is difficult for a user to change the amount of decompression while using an inversion table or gravity boots.

It would be desirable to provide spinal decompression in a head-up position and enable the user to control the amount of tension placed on his spine during treatment.

SUMMARY OF THE INVENTION

This invention is a spinal decompression device from which a user suspends himself with his head up, taking advantage of gravity to stretch his spine and relieve tension in his back. The device has two crosspieces, connected at their middle portions at a pivot point to form an X. Each crosspiece has an arm near the top and a foot at the bottom, all extending horizontally and perpendicularly to the crosspieces. The height of the arms and their distance apart from each other are adjustable to fit each user so that the user may control the amount of his body weight suspended between the arms during treatment, while resting some or all of his body weight on his feet that touch the ground. The device is collapsible around the pivot point to a smaller size for easier storage. A safety strap may be connected between the lower portions of each cross piece to prevent accidental collapse of the device. Wheels may be attached to the feet to make the device easier to move.

DETAILED DESCRIPTION OF THE INVENTION

Figure 1:
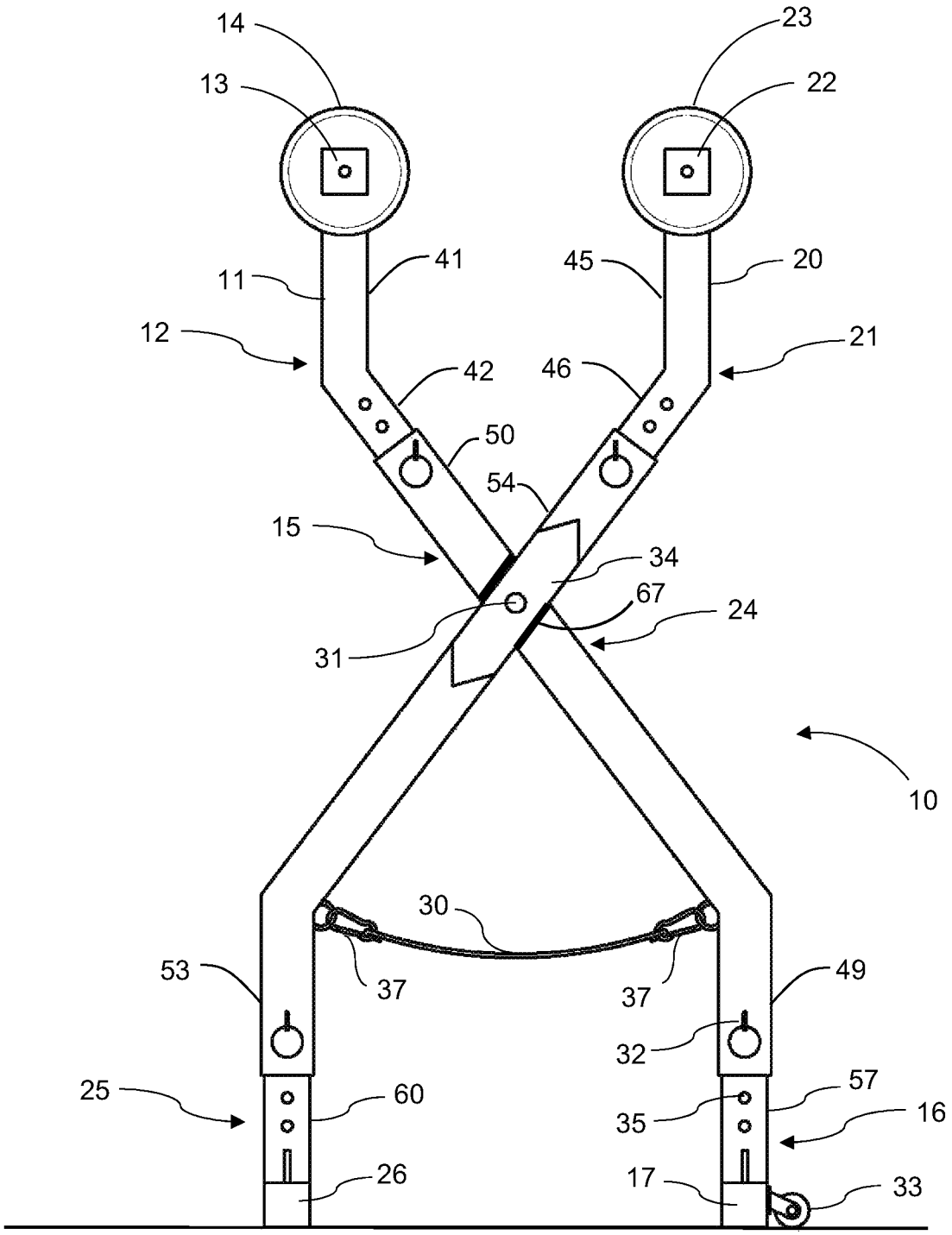
FIG. 1 illustrates a front view of the invention.

At its simplest, this spinal decompression device 10 has two crosspieces 11 and 20 that are connected at or near their middles at a pivot point to form an X. The crosspieces are essentially mirror images of each other. See FIGS. 1 and 3. The first and second crosspieces each have a top portion 12 and 21, respectively, from which an arm 13 and 22, respectively, extends. The arms 13, 22 are horizontal to the ground. The first and second crosspieces each also have a bottom portion 16 and 25, respectively, from which a horizontal foot 17 and 26, respectively, extends. The feet 17, 26 are horizontal to the ground. The device 10 stands on the feet and a user 9 suspends himself between the arms 13, 22 with his head up, taking advantage of gravity to stretch his spine and relieve tension in his back. See FIG. 2.

The device is configurable so that the user can suspend his weight by situating the arms in his armpits and hanging from the arms, as well as by friction of his torso against the arms. For comfort, preferably each of the arms 13, 22 is covered by an arm pad 14, 23. The height of the arms 13, 22 above the ground h and the distance between them, referred to herein as the arm width w, is customized to each user. When adjusted appropriately, the user's feet can touch the ground when his legs are straight or slightly flexed, so that the user controls the amount of tension and thus decompression on his spine by controlling how much of his weight is suspended between the arms. See FIG. 2.

The device 10 provides numerous adjustment points at which the components can be moved relative to each other to change the length or angle of the pieces relative to one another. Typically the portions slide in and out of each other. Once at the desired position, the relative positions of the portions are secured so that the length of the crosspiece stays constant during use. Various mechanisms such as buckles or latches maybe used to secure the portions in place, but preferably a removable pin 32 is inserted into holes that pass through both portions.

The first crosspiece 11 has three portions, a top 12, a middle 15, and a bottom 16. The top 12 has a vertical leg 41 and a diagonal leg 42. The middle 15 has a diagonal leg 50 and a vertical leg 49. The top's diagonal leg 42 is connected to the middle's diagonal leg 50 and the portions cooperate so that the crosspiece 11 can be extended or made shorter by moving the top's diagonal leg 42 relative to the middle's diagonal leg 50. This has the effect of increasing or decreasing the height of the first crosspiece's arm 13 from the ground and increasing or decreasing the width. The portions are secured in place relative to each other at the desired position.

The first crosspiece's bottom 16 has a vertical leg 57 and a horizontal foot 17. The bottom's vertical leg 57 is connected to the middle's vertical leg 49 and the portions cooperate so that the first crosspiece 11 can be extended or made shorter by moving the bottom's vertical leg 57 relative to the middle's vertical leg 49. This has the effect of increasing or decreasing the height of the arm 13 from the ground. The portions are secured in place relative to each other at the desired position.

The second crosspiece 20 has three portions, a top 21, a middle 24, and a bottom 26. The top 21 has a vertical leg 45 and a diagonal leg 46. The middle 24 has a diagonal leg 54 and a vertical leg 53. The top's diagonal leg 46 is connected to the middle's diagonal leg 54 and the portions cooperate so that the crosspiece 20 can be extended or made shorter by moving the top's diagonal leg 46 relative to the middle's diagonal leg 54. This has the effect of increasing or decreasing the height of the second crosspiece's arm 22 from the ground and increasing or decreasing the width. The portions are secured in place relative to each other at the desired position.

The second crosspiece's bottom 25 has a vertical leg 60 and a horizontal foot 26. The bottom's vertical leg 60 is connected to the middle's vertical leg 53 and the portions cooperate so that the second crosspiece 20 can be extended or made shorter by moving the bottom's vertical leg 60 relative to the middle's vertical leg 53. This has the effect of increasing or decreasing the height of the second crosspiece's arm 22 from the ground. The portions are secured in place relative to each other at the desired position.

Figure 4:
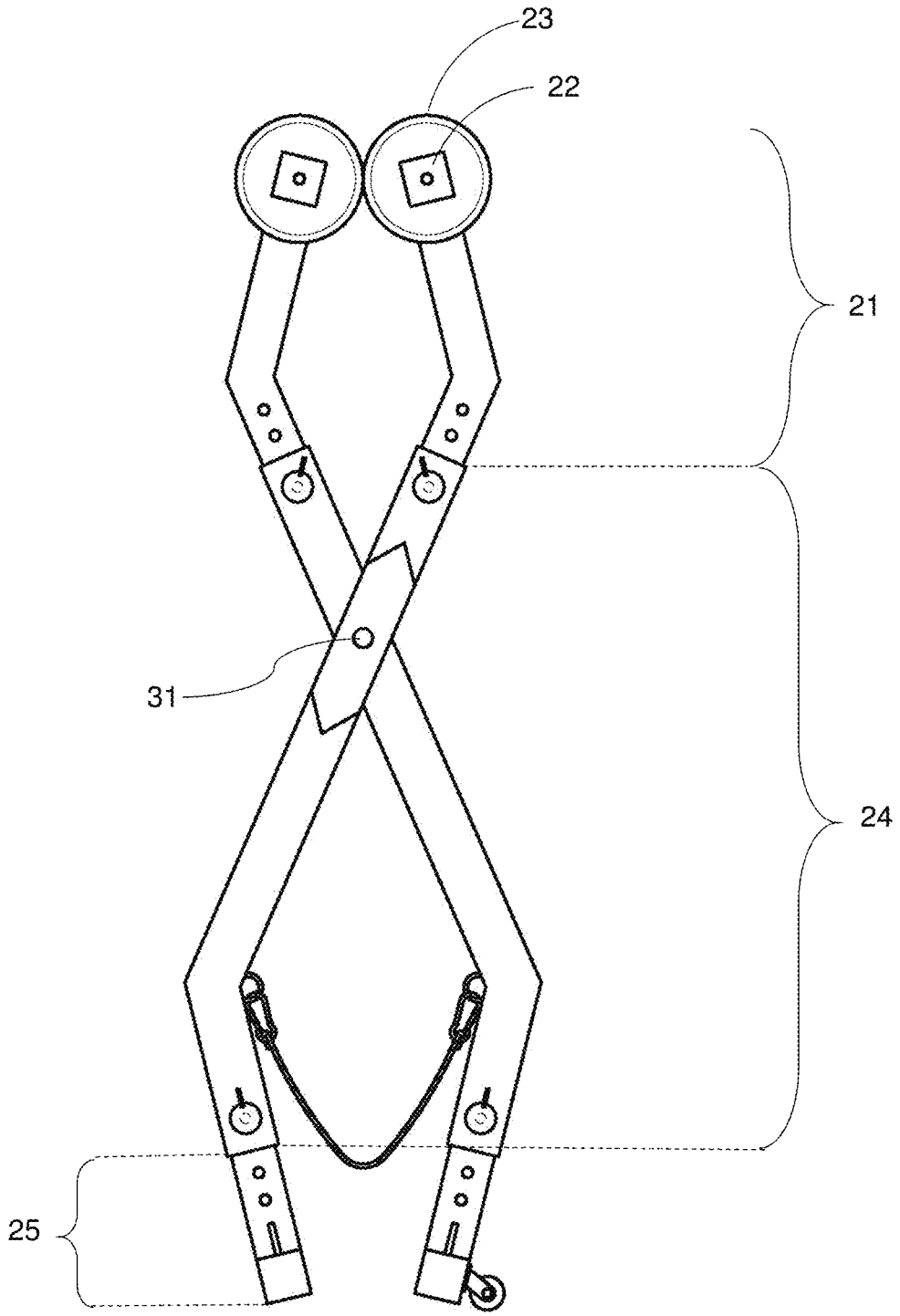
FIG. 4 illustrates a front view of the invention collapsed at the pivot point so that the arm pads are adjacent to each other.
Figure 5:
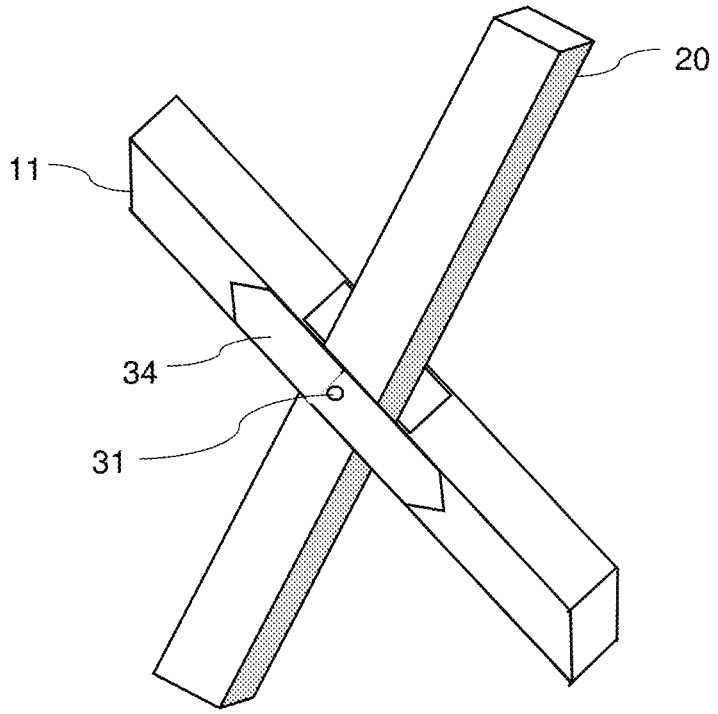
FIG. 5 is a partial view of the device illustrating the connection of the first and second crosspieces.

The first crosspiece 11 and second crosspiece 20 are connected to each other at their middle portions 15, 24. To prevent the device 10 from being top-heavy and unstable, typically the first and second crosspieces are connected at a point that is above the physical center of each crosspiece so that the portion of the device 10 above the pivot point is shorter and therefore lighter than the portion of the device 10 below the pivot point. In one embodiment, the crosspieces 11, 22 are permanently fixed to each other, such as by weld 67 or bolt 68. In the preferred embodiment, the crosspieces 11, 22 are rotatably connected to each other at a pivot point 31, which permits the width to be adjusted by moving the crosspieces toward and away from each other. The crosspieces can be placed on top of each other like scissors, but instead one crosspiece is preferably inserted into the other as shown in FIG. 5. This has the advantage of keeping the arms, feet, and crosspieces at the same depth. The crosspieces 11, 22 are secured in place relative to each other at the desired position. Connection at a pivot point 31 also enables the crosspieces 11, 22 to be collapsed toward each other, reducing the size of the device for easier storage. See FIG. 4.

For the fixed or rotatable versions, a width-retention mechanism 30 may be used to ensure the crosspieces stay the desired width apart. In one embodiment, the width-retention mechanism 30 is a strap secured at each end with carabiners 37 to the crosspieces. The strap may be made of a flexible material such as woven nylon or polyester, but may also be of a more rigid material such as metal or other material.

For added convenience, wheels may be attached to the device to make it easier to move. In one embodiment wheels 33 are attached to the feet 17, 26 by casters. See FIGS. 1 and 3.

Figure 2:
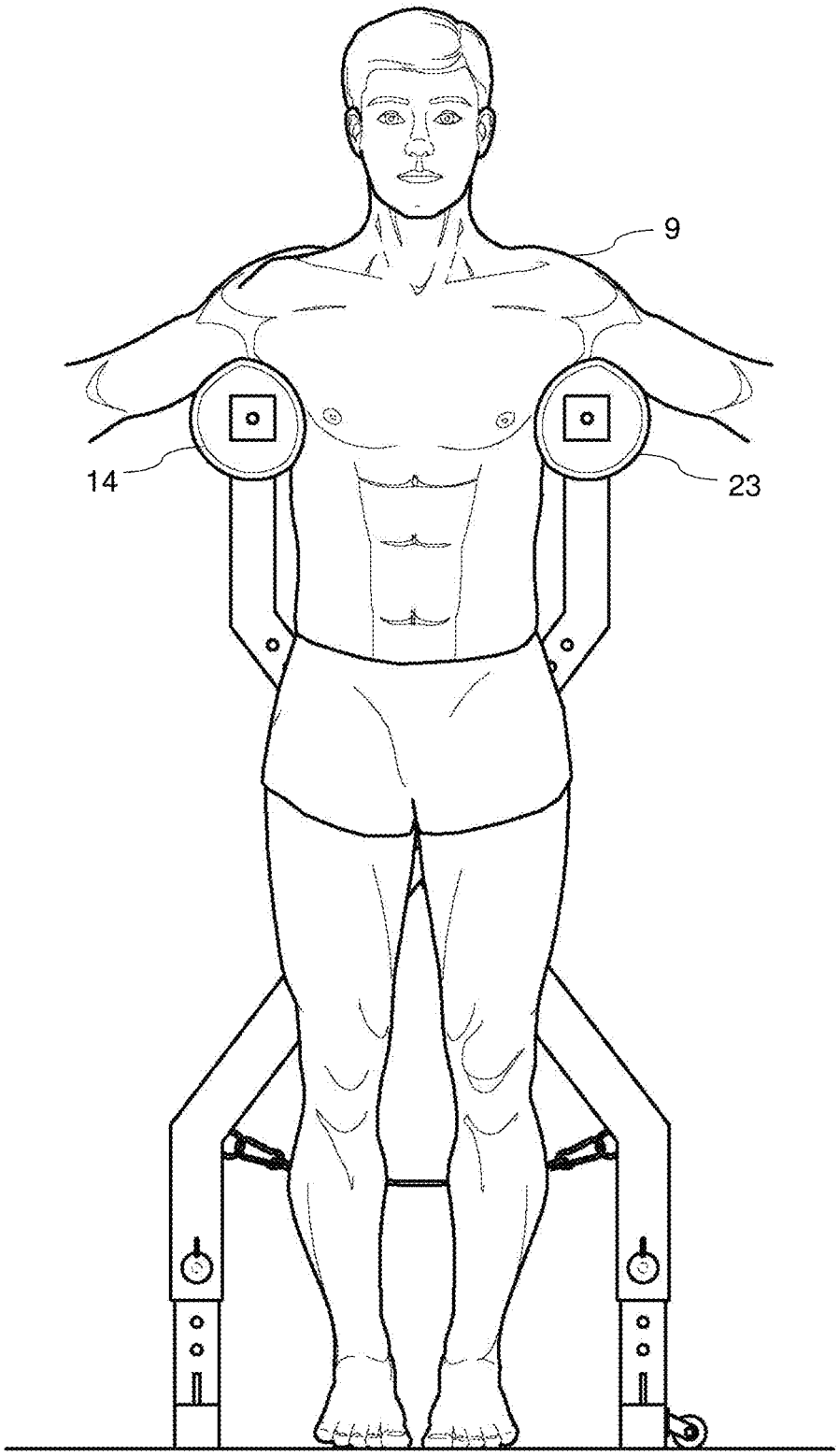
FIG. 2 illustrates a front view of a user using the invention.
Figure 3:
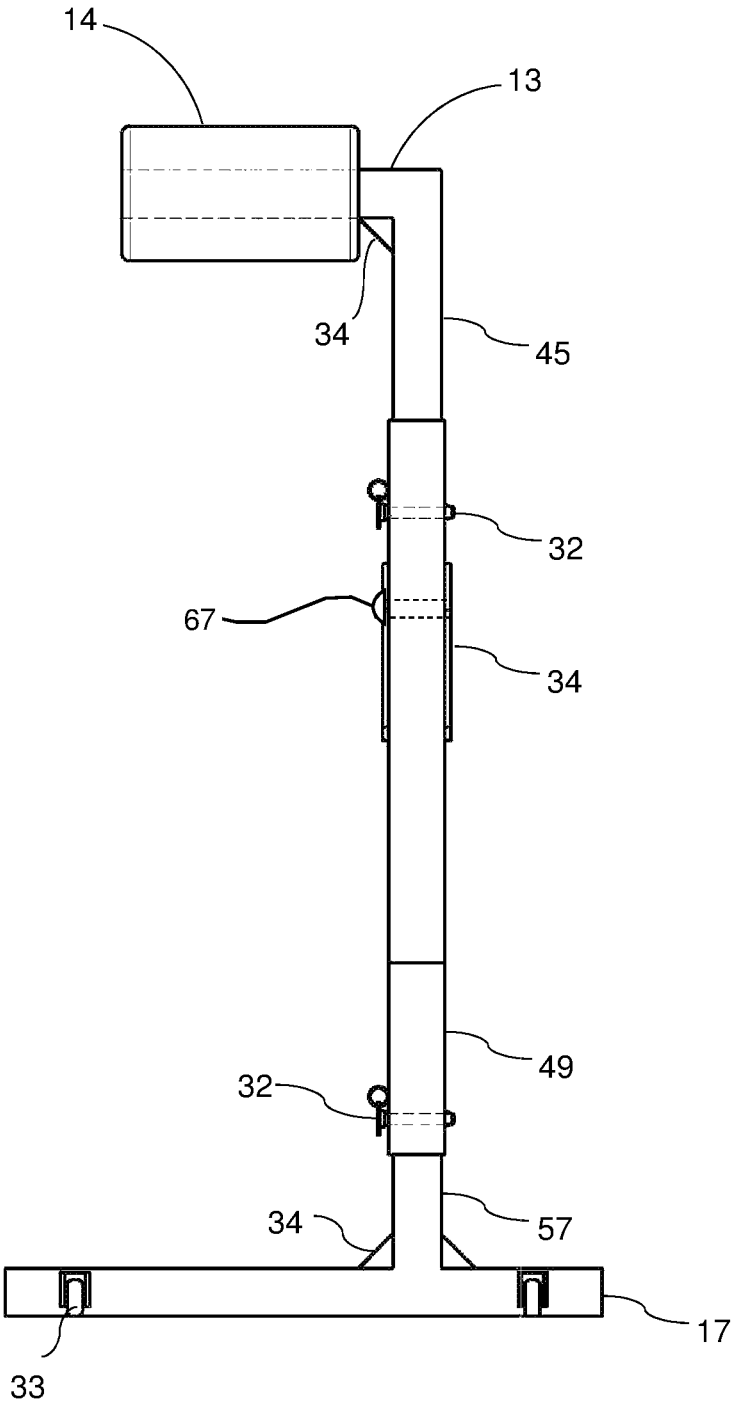
FIG. 3 illustrates a side view of the invention.

The crosspieces are made of a rigid material of sufficient girth to support a human of several hundred pounds. Typically hollow steel tubing of circular or square cross section is used, but in some cases, plastic or even solid materials will suffice. Gussets may be welded at stress points, such as under the arms 13, 22 or near the pivot point, to strengthen the device. FIG. 1 shows gussets 34 on the middle 24 of the second crosspiece and FIG. 3 shows gussets supporting the arm and foot.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

What is claimed is:

1. A spinal decompression device comprising:

a. a Z-shaped first crosspiece having a top, a middle and a bottom portion;

b. a Z-shaped second crosspiece having a top, a middle and a bottom portion wherein the Z-shaped second crosspiece is permanently fixed to the Z-shaped first crosspiece by a weld so that the Z-shaped crosspieces cannot rotate towards or away from each other;

c. a first arm extending horizontally from the top portion of the Z-shaped first crosspiece;

d. a second arm extending horizontally from the top portion of the Z-shaped second crosspiece;

e. a first arm pad connected to the first arm;

f. a second arm pad connected to the second arm;

g. a first foot extending from the bottom portion of the Z-shaped first crosspiece; and h. a second foot extending from the bottom portion of the Z-shaped second crosspiece; wherein i. the top portion of the Z-shaped first crosspiece comprises a vertical leg and a diagonal leg;

j. the top portion of the Z-shaped second crosspiece comprises a vertical leg and a diagonal leg;

k. the middle portion of the Z-shaped first crosspiece comprises a vertical leg and a diagonal leg;

l. the middle portion of the Z-shaped second crosspiece comprises a vertical leg and a diagonal leg;

m. the bottom portion of the Z-shaped first crosspiece comprises a vertical leg and a horizontal foot;

n. the bottom portion of the Z-shaped second crosspiece comprises a vertical leg and a horizontal foot;

o. the diagonal leg of the top portion of the Z-shaped first crosspiece cooperates with the diagonal leg of the middle portion of the Z-shaped first crosspiece such that the separation between the arm of the Z-shaped first crosspiece from the arm of the Z-shaped second crosspiece is increased or decreased; and p. the diagonal leg of the top portion of the Z-shaped second crosspiece cooperates with the diagonal leg of the middle portion of the Z-shaped second crosspiece such that the separation between the arm of the Z-shaped first crosspiece from the arm of the Z-shaped second crosspiece is increased or decreased.

2. A spinal decompression device comprising:

a. a Z-shaped first crosspiece having a top, a middle and a bottom portion;

b. a Z-shaped second crosspiece having a top, a middle and a bottom portion wherein the second Z-shaped crosspiece is permanently fixed to the Z-shaped first crosspiece by a weld so that the Z-shaped crosspieces cannot rotate towards or away from each other;

c. a first arm extending horizontally from the top portion of the Z-shaped first crosspiece;

d. a second arm extending horizontally from the top portion of the Z-shaped second crosspiece;

e. a first arm pad connected to the first arm;

f. a second arm pad connected to the second arm;

g. a first foot extending from the bottom portion of the Z-shaped first crosspiece; and h. a second foot extending from the bottom portion of the Z-shaped second crosspiece; wherein i. the top portion of the Z-shaped first crosspiece comprises a vertical leg and a diagonal leg;

j. the top portion of the Z-shaped second crosspiece comprises a vertical leg and a diagonal leg;

k. the middle portion of the Z-shaped first crosspiece comprises a vertical leg and a diagonal leg;

l. the middle portion of the Z-shaped second crosspiece comprises a vertical leg and a diagonal leg;

m. the bottom portion of the Z-shaped first crosspiece comprises a vertical leg and a horizontal foot;

n. the bottom portion of the Z-shaped second crosspiece comprises a vertical leg and a horizontal foot;

o. the vertical leg of the bottom portion of the Z-shaped first crosspiece cooperates with the vertical leg of the middle portion of the Z-shaped first crosspiece such that the height of the arm of the Z-shaped first crosspiece from the ground is increased or decreased; and p. the vertical leg of the bottom portion of the Z-shaped second crosspiece cooperates with the vertical leg of the middle portion of the Z-shaped second crosspiece such that the height of the arm of the Z-shaped second crosspiece from the ground is increased or decreased.

3. The device of claim 1, wherein the first and second arms are configured at a height above the ground such that, when the arms are snug in a user's armpits, the user can touch his feet to the ground to control how much of his body weight is supported by the first and second arms.

4. The device of claim 1, wherein:

a. the vertical leg of the middle portion of the Z-shaped first crosspiece is mated to and movable relative to the vertical leg of the bottom portion of the Z-shaped first crosspiece such that moving the vertical leg of the bottom portion of the Z-shaped first crosspiece causes the distance between the first arm and the ground to increase; and b. the vertical leg of the middle portion of the Z-shaped second crosspiece is mated to and movable relative to the vertical leg of the bottom portion of the Z-shaped second crosspiece, such that moving the vertical leg of the bottom portion of the Z-shaped second crosspiece causes the distance between the second arm and the ground to increase.

5. The device of claim 1, further comprising a width retention mechanism between the first and second Z-shaped crosspieces.

6. The device of claim 1, further comprising one or more first wheels attached to the first foot and one or more second wheels attached to the second foot.

7. The device of claim 2, wherein the first and second arms are configured at a height above the ground such that, when the arms are snug in a user's armpits, the user can touch his feet to the ground to control how much of his body weight is supported by the first and second arms.

8. The device of claim 2, wherein:

a. the diagonal leg of the top portion of the Z-shaped first crosspiece is mated to and movable relative to the diagonal leg of the middle portion of the Z-shaped first crosspiece; and b. the diagonal leg of the top portion of the Z-shaped second crosspiece is mated to and movable relative to the diagonal leg of the middle portion of the Z-shaped second crosspiece; such that moving both the diagonal leg of the top portion of the Z-shaped first crosspiece and the diagonal leg of the top portion of the Z-shaped second crosspiece causes the distance between the first arm and the second arm to increase.

9. The device of claim 2, further comprising a width retention mechanism between the first and second Z-shaped crosspieces.

10. The device of claim 2, further comprising one or more first wheels attached to the first foot and one or more second wheels attached to the second foot.

* * * * *